US006949884B2

(12) United States Patent
Shih et al.

(10) Patent No.: US 6,949,884 B2
(45) Date of Patent: Sep. 27, 2005

(54) METHOD FOR DRIVING ORGANIC LIGHT EMITTING DIODES AND RELATED CIRCUIT

(75) Inventors: Li-Wei Shih, Chia-Yi Hsien (TW); Chun-Huai Li, Ping-Tung Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 0 days.

(21) Appl. No.: 10/707,439

(22) Filed: Dec. 15, 2003

(65) Prior Publication Data

US 2004/0196222 A1 Oct. 7, 2004

(30) Foreign Application Priority Data

Apr. 7, 2003 (TW) ..... 92107923 A

(51) Int. Cl.[7] ..... G09G 3/10
(52) U.S. Cl. ..... 315/169.3; 345/204
(58) Field of Search ..... 315/169.1, 169.3; 345/204, 211–212, 45, 76, 82, 92

(56) References Cited

U.S. PATENT DOCUMENTS

| | | | | |
|---|---|---|---|---|
| 6,486,606 | B1 * | 11/2002 | Ting | 315/169.1 |
| 6,577,302 | B2 | 6/2003 | Hunter et al. | 345/204 |
| 6,603,456 | B1 | 8/2003 | Aoki et al. | 345/100 |
| 6,677,713 | B1 * | 1/2004 | Sung | 315/169.1 |
| 2002/0140646 | A1 * | 10/2002 | Sato | 345/82 |
| 2002/0171611 | A1 * | 11/2002 | Cok | 345/82 |
| 2003/0197665 | A1 * | 10/2003 | Sung | 345/82 |

* cited by examiner

*Primary Examiner*—Thuy Vinh Tran
(74) *Attorney, Agent, or Firm*—Winston Hsu

(57) ABSTRACT

A method for driving an organic light emitting diode (OLED). The method adjusts the voltage at an end of a capacitor connected to a gate of a metal oxide semiconductor (MOS) transistor serially connected to the OLED when the MOS transistor is actuated and emits the currents for the OLED to emit light.

13 Claims, 10 Drawing Sheets

METHOD FOR DRIVING ORGANIC LIGHT EMITTING DIODES AND RELATED CIRCUIT

BACKGROUND OF INVENTION

1. Field of the Invention

The present invention relates to an organic light emitting diode (OLED), and more particularly, to a method for driving the OLED and related OLED driving circuit.

2. Description of the Prior Art

Having a variety of advantages, such as high light intensity, high response velocity, wide viewing angle, spontaneous light source and thin appearance, an organic light emitting diode (OLED) is becoming one of the most popular light emitting components that form a display device.

An OLED is a current-driving component. That is, the intensity of light (gray scale) emitted by an OLED can be controlled by determining currents flowing through the OLED.

A method for controlling the intensity of light emitted by an OLED by adjusting levels of currents flowing through the OLED is to adjust a voltage at a gate of a thin film transistor (TFT) serially connected to the OLED to control the levels of currents flowing through the OLED and to control the intensity of light emitted by the OLED. The TFT and the OLED combine to form an active display cell. The larger a voltage difference between the gate and a source of the TFT is, the greater the currents flowing through the OLED are and the larger the gray scale that the OLED performs becomes, and vice versa.

In the process that the TFT drives the OLED, not only the quality of the OLED dominates the performance of images displayed by the active display cell, but also how stable a threshold voltage of a transistor used to drive the TFT can be sustained is a key factor in determining whether the active display cell can display for a long enough period of time or not. Please refer to FIG. 1, which is a circuit diagram of an active display cell 10 according to the prior art. The cell 10 comprises a PMOS transistor $T_1$ and an OLED 80 serially connected to the PMOS $T_1$. A source, a gate and a drain of the PMOS $T_1$ are connected to a first voltage source $V_{dd}$, a control voltage source $V_C$ and an anode of the OLED 80 respectively. A cathode of the OLED 80 is connected to a second voltage source $V_{SS}$.

When a voltage generated by the control voltage $V_C$ is too small to turn on the PMOS $T_1$ the PMOS $T_1$ does not actuate any currents and the OLED 80 serially connected to the PMOS $T_1$ does not emit light either. On the contrary, when the control voltage source $V_C$ generates a voltage that is large enough to turn on the PMOS $T_1$, the PMOS $T_1$ is turned on and actuates its currents capable of enabling the OLED 80 to emit light. Since the OLED 80 is an electronic component meant for emitting light, the PMOS $T_1$ flows all the time the currents are capable of driving the OLED 80 to emit light. Whenever the PMOS $T_1$ has currents flowing through, current carriers (holes for PMOS) are to flow along a direction directed by a first electric field $E_1$ all the way from the source to the drain of the PMOS $T_1$, and some current carriers may accumulate at a region between the source and the drain of the PMOS $T_1$, resulting in a decrease of a threshold voltage $V_{thp}$ of the PMOS $T_1$.

Please refer to an equation 1, $I_{d\,p}=K(V_{gs\,p}+V_{th\,p})^2$, which is a relation of a current $I_{dp}$ flowing through the PMOS $T_1$ and a difference between a voltage difference $V_{gsp}$ between the gate and the source of the PMOS $T_1$ and the threshold voltage $V_{thp}$ of the PMOS $T_1$. It can be seen from the equation 1 that when the voltage difference $V_{gsp}$ is kept constant, the current $I_{dp}$ flowing through the PMOS $T_1$ drops as the threshold voltage $V_{thp}$ of the PMOS $T_1$ decreases. Therefore, currents flowing through the PMOS $T_1$ controlled by a constant voltage, voltage difference $V_{gsp}$ between the date and the source of the PMOS $T_1$, will diminish as time goes by and the OLED 80 can only emit dimmer and dimmer light.

In FIG. 1, what the active display cell 10 utilizes to control the OLED 80 to emit light is the PMOS $T_1$. However, the active display cell 10 can comprise an NMOS to control operations of the OLED 80 instead. Please refer to FIG. 2, which is a circuit diagram of a second active display cell 20 according to the prior art. The cell 20 comprises an NMOS $T_2$ and an OLED 82 serially connected to the NOMS $T_2$. A source, a gate and a drain of the NMOS $T_2$ are connected to a second voltage source $V_{SS}$, the control voltage source $V_C$ and a cathode of the OLED 82. An anode of the OLED 82 is connected to the first voltage source $V_{dd}$.

When the control voltage source $V_C$ generates a voltage to turn off the NMOS $T_2$, the NMOS $T_2$ does not generate any currents and the OLED 82 serially connected to the NMOS $T_2$ does not emit any light either. On the contrary, when a voltage that the control voltage source $V_C$ generates is large enough to turn on the NMOS $T_2$, the NMOS $T_2$ will actuate currents capable of enabling the OLED 82 to emit light. Whenever the NMOS $T_2$ has currents flowing through, current carriers (electron for NMOS) will flow along a direction opposite to a direction directed by a second electron field $E_2$ all the way from the source to the drain of the NMOS $T_2$, and some of the current carriers may accumulate at a region between the source and the gate of the NMOS $T_2$, resulting in an increase of a threshold voltage $V_{thn}$ of the NMOS $T_2$.

Please refer to an equation 2, $I_{d\,n}=K(V_{gs\,n}-V_{th\,n})^2$, which shows a relation between a current $I_{dn}$ flowing through the NMOS $T_2$ and a difference between a voltage difference $V_{gsn}$ between the gate and the source of the NMOS $T_2$ and a threshold voltage $V_{thn}$ of the NMOS $T_2$. The equation 2 shows that when the voltage difference $V_{gsn}$ is kept constant, the current $I_{dn}$ drops as the threshold voltage $V_{thn}$ increases. Therefore, currents flowing through the NMOS $T_2$ controlled by a constant voltage, voltage difference $V_{gsn}$ between the date and the source of the NMOS $T_2$, will diminish as time goes by and the OLED 82 can only emit dimmer and dimmer light.

SUMMARY OF INVENTION

It is therefore a primary objective of the claimed invention to provide a method for driving an OLED to overcome the drawbacks of the prior art.

According to the claimed invention, the method comprises following steps: (a) providing a first metal oxide semiconductor (MOS) transistor, whose first and second ends are connected to an OLED and to a first voltage source respectively; (b) providing a capacitor, whose first end is connected to a gate of the first MOS transistor; (c) providing a second MOS transistor, whose first end is utilized for inputting data, a second end of the second MOS transistor being connected to the first end of the capacitor; (d) turning on the second MOS transistor and inputting data from the first end of the second MOS transistor to the second end of the second MOS transistor; and (e) turning off the second MOS transistor after step (d), and adjusting a voltage at a second end of the capacitor from a first voltage level to a second voltage level different from the first voltage level sequentially for enabling a voltage at the first end of the capacitor to control currents flowing through the OLED.

It is an advantage of the claimed invention that a method to drive an OLED by adjusting a voltage at the gate of the first transistor and by decreasing currents flowing through the first transistor when the OLED is actuated to emit light omits the possibility of charge accumulation and stabilizes the $V_{th}$.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
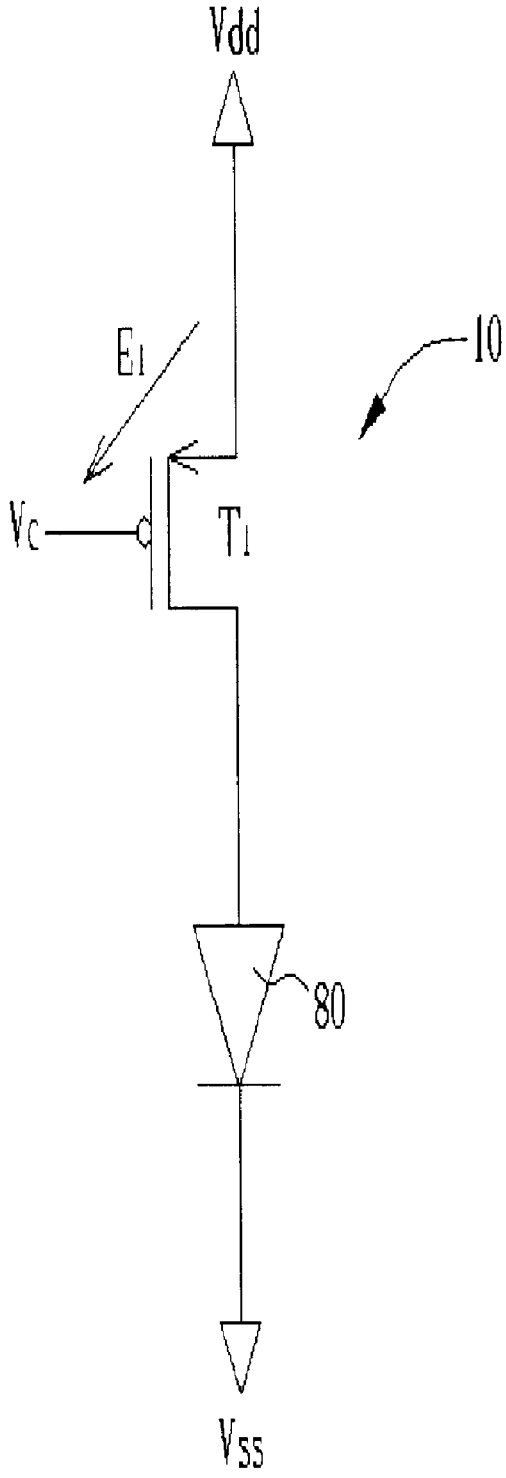
Fig. 1 Prior art
FIG. 1 is a circuit diagram of a first active display cell according to the prior art.
Figure 2:
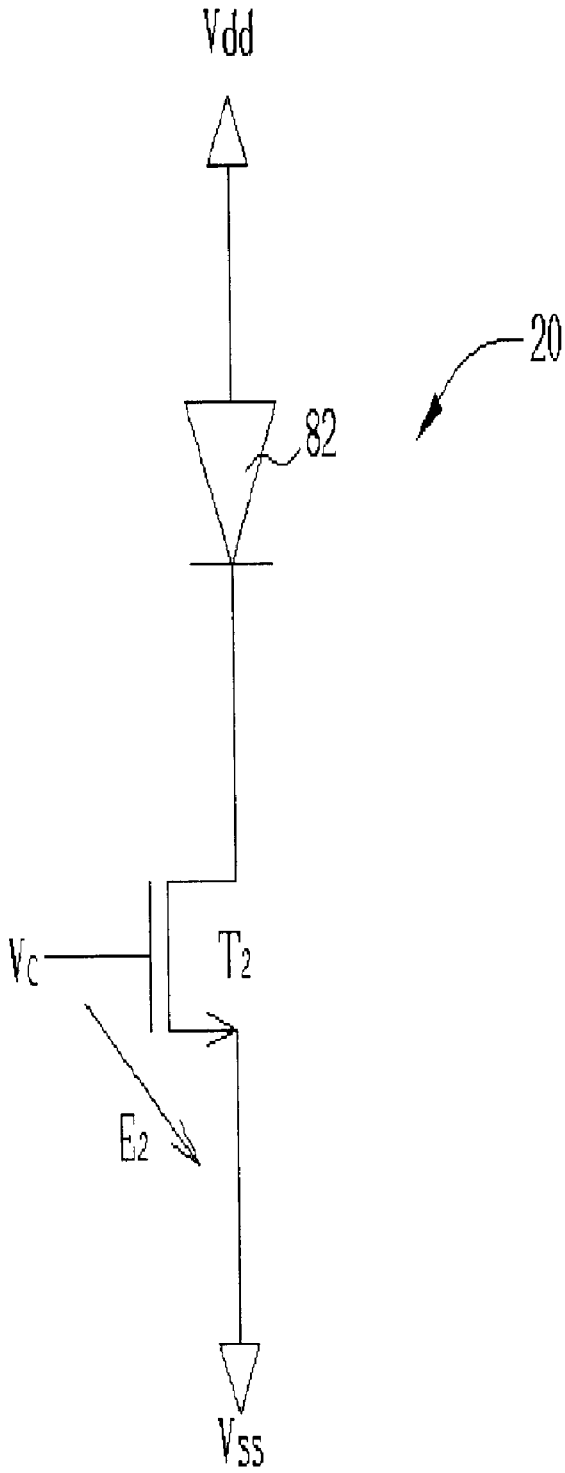
Fig. 2 Prior art
FIG. 2 is a circuit diagram of a second active display cell according to the prior art.
Figure 3:
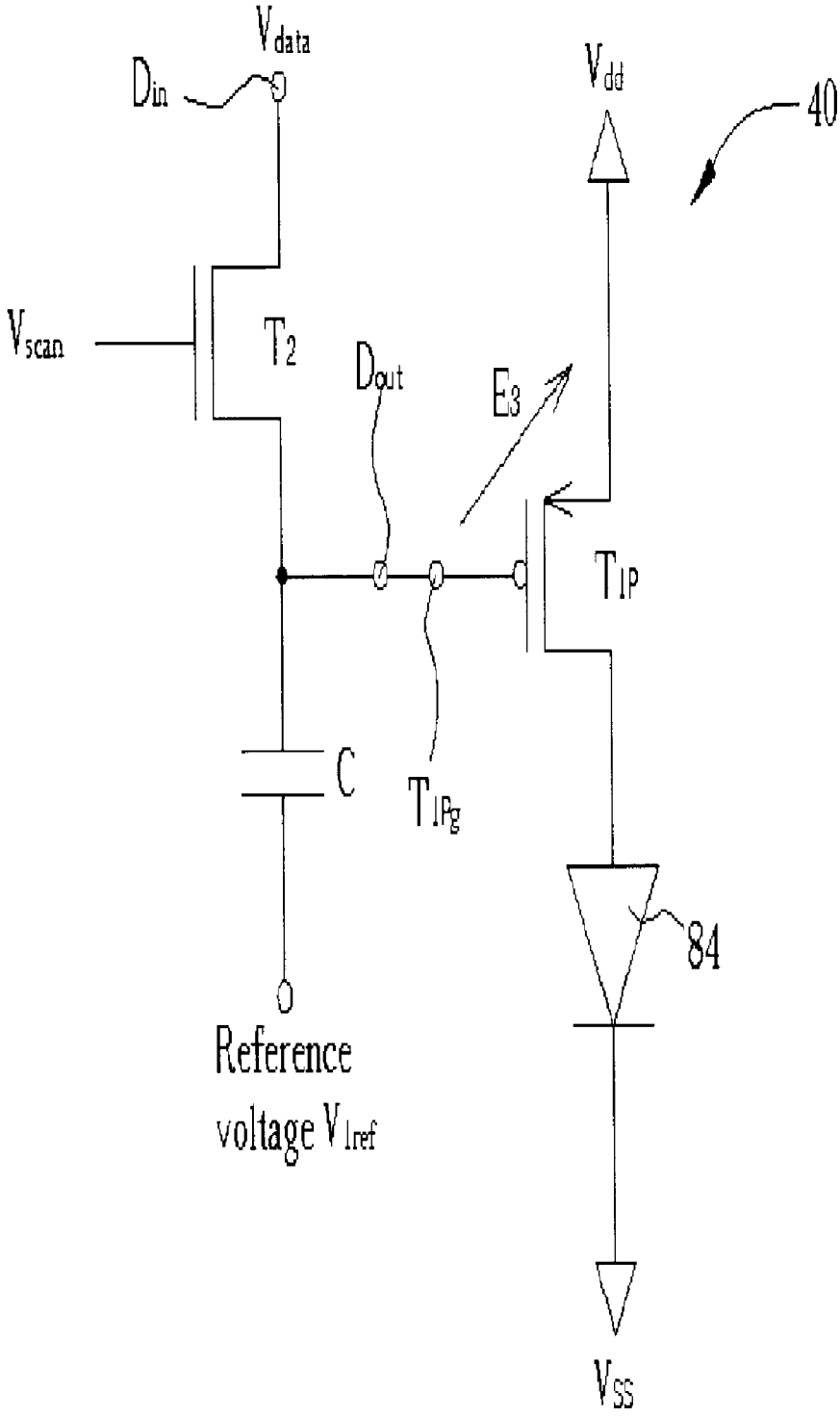
FIG. 3 is a circuit diagram of a driving circuit to drive an OLED according to the present invention.

Please refer to FIG. 3, which is a circuit diagram of a first driving circuit 40 to drive an OLED 84 according to the present invention. The driving circuit 40 comprises a first PMOS $T_{1p}$, a capacitor C and a second MOS $T_2$ for inputting data at an input end $D_{in}$. A first end of the first PMOS $T_{1p}$ is connected to an anode of the OLED 84. A second end of the PMOS $T_{1p}$ is connected to a first voltage source $V_{dd}$. A first end and a second end of the capacitor C are connected to a gate $T_{1Pg}$ of the PMOS T1p and a reference voltage source $V_{1ref}$ respectively. An output end $D_{out}$ of the second MOS $T_2$ is connected to the first end of the capacitor C. A control end of the second MOS $T_2$ is connected to a scan voltage source $V_{scan}$. The first PMOS $T_{1p}$ can be a TFT transistor.

Operations of the driving circuit 40 are described as follows: controlling the scan voltage source $V_{scan}$ to continue to output a voltage to turn on the second MOS transistor $T_2$ so that data at the input end $D_{in}$ of the second transistor $T_2$ can be transmitted to the output end $D_{out}$ of the second transistor $T_2$ (the first end of the capacitor C) until a voltage at the first end of the capacitor C (the gate $T_{1Pg}$ of the first PMOS transistor $T_{1p}$) is charged to a voltage equal to a data voltage $V_{data}$ of the input data, resulting that currents flowing through the first PMOS transistor $T_{1p}$ for controlling the intensity of light emitted by the OLED 84 at this moment vary with the change of a voltage at the gate $T_{1Pg}$ of the first PMOS transistor $T_{1p}$ (the first end of the capacitor C, the data voltage $V_{data}$). That is, the lower the data voltage $V_{data}$ is, the lower the voltages at the first end of the capacitor C and the gate $T_{1Pg}$ of the first PMOS transistor $T_{1p}$ become. A voltage at the gate $T_{1Pg}$ of the first PMOS transistor $T_{1p}$ having a high enough voltage level actuates the first PMOS transistor $T_{1p}$ to flow with currents of greater current levels and drive the OLED 84 to emit light of greater intensity levels, accomplishing a function performed by the driving circuit 40 to adjust the intensity of light emitted by the OLED 84 according to the data (the data voltage $V_{data}$).

Figure 4:
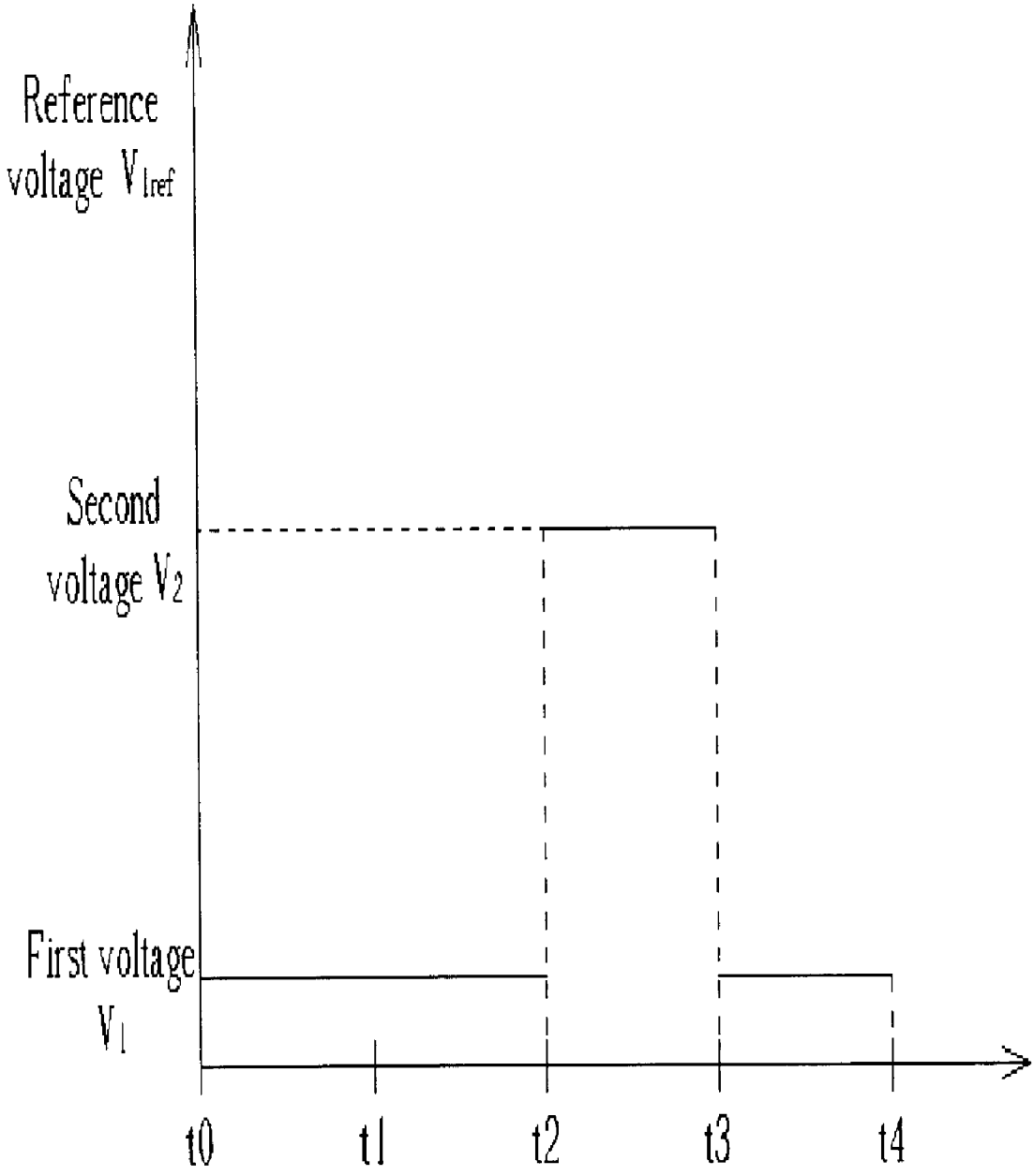
FIG. 4 is a first timing diagram of a first reference voltage source applied to the driving circuit shown in FIG. 3 according to the present invention.

After the voltage at the first end of the capacitor C is charged to be of a voltage level equal to the data voltage $V_{data}$ of the data, controlling the scan voltage source $V_{scan}$ to output a voltage at a time $t_1$ to turn off the second transistor $T_2$ and turning off the second transistor $T_2$, and adjusting a voltage of the first reference voltage source $V_{1ref}$ sequentially. Please refer to FIG. 4, which is a timing diagram of the first reference voltage source $V_{1ref}$ of the driving circuit 40 according to the present invention. The first reference voltage source $V_{1ref}$ generates a first voltage $V_1$ during intervals from times to $t_o$ to $t_2$ and from times $t_3$ to $t_4$, and generates a second voltage $V_2$ during a remaining interval from times $t_2$ to $t_3$. The time $t_0$ shown in FIG. 4 is almost simultaneous with or slightly lags a time when the scan voltage source $V_{scan}$ starts to output the voltage to turn on the second transistor $T_2$, while the time $t_1$ shown in FIG. 4 is a time when the scan voltage source $V_{scan}$ starts to output the voltage to turn off the second transistor $T_2$. A voltage difference between the first and the second end of the capacitor C at the time $t_1$ is equal to a voltage subtracted by the first voltage $V_1$ from the data voltage $V_{data}$. Because the second transistor $T_1$ is kept turned off after the time $t_1$, charges stored in the capacitor C has no way to flow and the voltage difference between the first and the second end of the capacitor C does not change at all. As the first reference voltage source $V_{1ref}$ generates the first voltage $V_1$ during the intervals from times $t_1$ to $t_2$ and from times $t_3$ to $t_4$, a voltage at the first end of the capacitor C is equal to the data voltage $V_{data}$. As the first reference voltage source $V_{1ref}$ generates the second voltage $V_2$ during the interval from times $t_2$ to $t_3$, the voltage at the first end of the capacitor C is equal to the data voltage $V_{data}$+(the second voltage $V_2$ the first voltage $V_1$). A voltage increased at the first end of the capacitor C (the second voltage $V_2$ the first voltage $V_1$) forms an electric field $E_3$, whose direction is opposed to the direction of the electric field $E_1$, on a region between the source and the gate $T_{1Pg}$ of the first PMOS transistor $T_{1p}$ equivalently. The electric field $E_3$ decreases a number of holes accumulated in the region between the source and the gate $T_{1Pg}$ of the first PMOS transistor $T_{1p}$, therefore accomplishing the goal to stabilize the threshold voltage $V_{th}$ and to enable the PMOS $T_{1p}$ to emit stable currents under a stable gate voltage, so as to enable the OLED to emit stable light.

Figure 5:
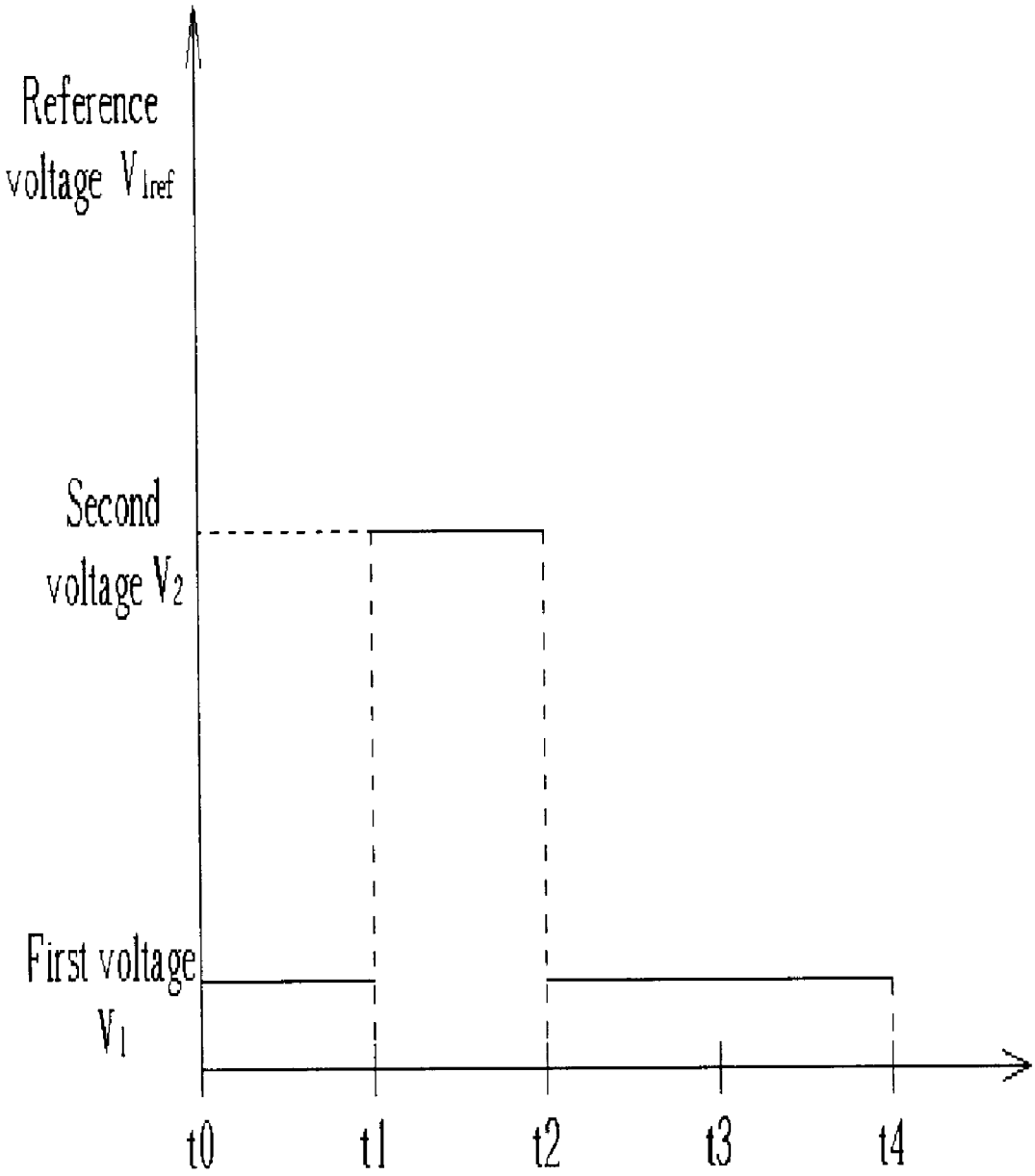
FIG. 5 is a second timing diagram of a first reference voltage source applied to the driving circuit shown in FIG. 3 according to the present invention.
Figure 6:
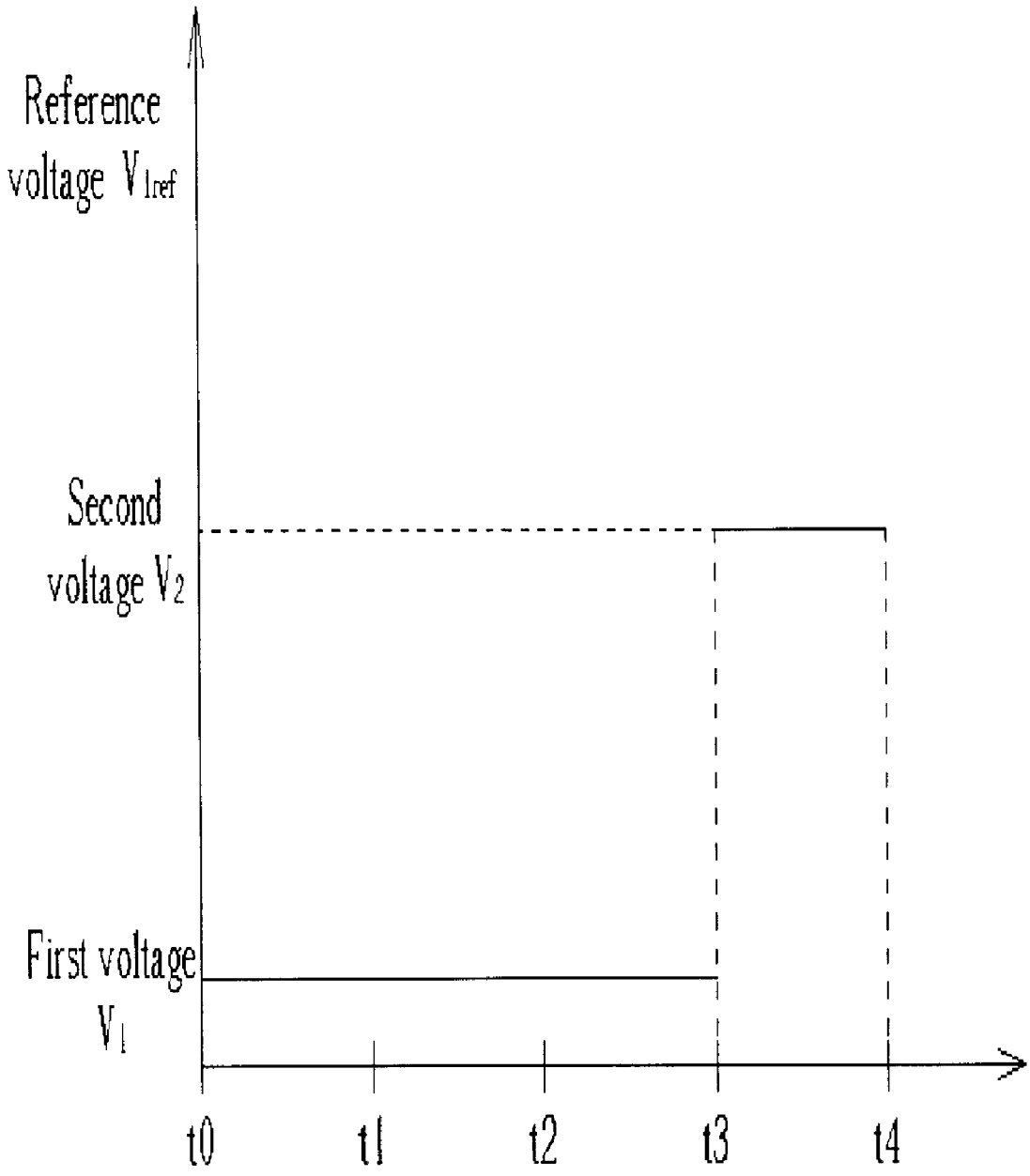
FIG. 6 is a third timing diagram of a first reference voltage source applied to the driving circuit shown in FIG. 3 according to the present invention.

The first reference voltage source $V_{1ref}$ shown in FIG. 4 generates the second voltage $V_2$, whose level is higher than that of the first voltage $V_1$, during the interval from times $t_2$ to $t_3$. The first reference voltage source $V_{1ref}$ can also surely generate the second voltage $V_2$ during other intervals in addition to the interval from times $t_2$ to $t_3$. Please refer to FIG. 5 and to FIG. 6, which are two timing diagrams of the first reference voltage source $V_{1ref}$ according to the present invention. In FIG. 5, the first reference voltage source $V_{1ref}$ generates the second voltage $V_2$ during the interval from times $t_1$ to $t_2$ while generating the first voltage $V_1$ during the remaining intervals, so charges accumulated during the interval from times $t_1$ to $t_2$ can be released can the threshold voltage $V_{th}$ can be kept stable. In FIG. 6, the first reference voltage source $V_{1ref}$ generates the second voltage $V_2$ during the interval from times $t_3$ to $t_4$ while generating the first voltage $V_1$ during the remaining intervals, so charges accumulated during the interval from times $t_3$ to $t_4$ can be released can the threshold voltage $V_{th}$ can be kept stable.

Since a value of gray scales performed by an OLED relates to the levels of currents flowing through the OLED, the greater the currents flowing through the OLED are, the larger the value of gray scale performed by the OLED becomes.

The first PMOS transistor $T_{1p}$ of the driving circuit 40 for driving the OLED 84 can be substituted by an NMOS transistor. Please refer to FIG. 7, which is a circuit diagram of a second driving circuit 60 for driving an OLED 86 according to the present invention. The driving circuit 60 comprises a first NMOS transistor $T_{1n}$, the second MOS transistor $T_2$ and the capacitor C. A first end of the first NMOS transistor $T_{1n}$ is connected to a cathode of the OLED 86. A second end of the first NMOS transistor $T_{1n}$ is connected to a second voltage source $V_{SS}$. The first end of the capacitor C is connected to a gate $T_{1ng}$ of the first NMOS transistor $T_{1n}$(1N?). The second end of the capacitor C is connected to a second reference voltage source $V_{2ref}$. The input end $D_{in}$ of the second MOS transistor $T_2$ of the driving circuit 60 is also utilized to input data. The output end $D_{out}$ of the second MOS transistor $T_2$ is connected to the first end of the capacitor C. The control end of the second MOS transistor $T_2$ is connected to the scan voltage source $V_{scan}$. The first NMOS transistor $T_{1n}$ can be a TFT.

Figure 7:
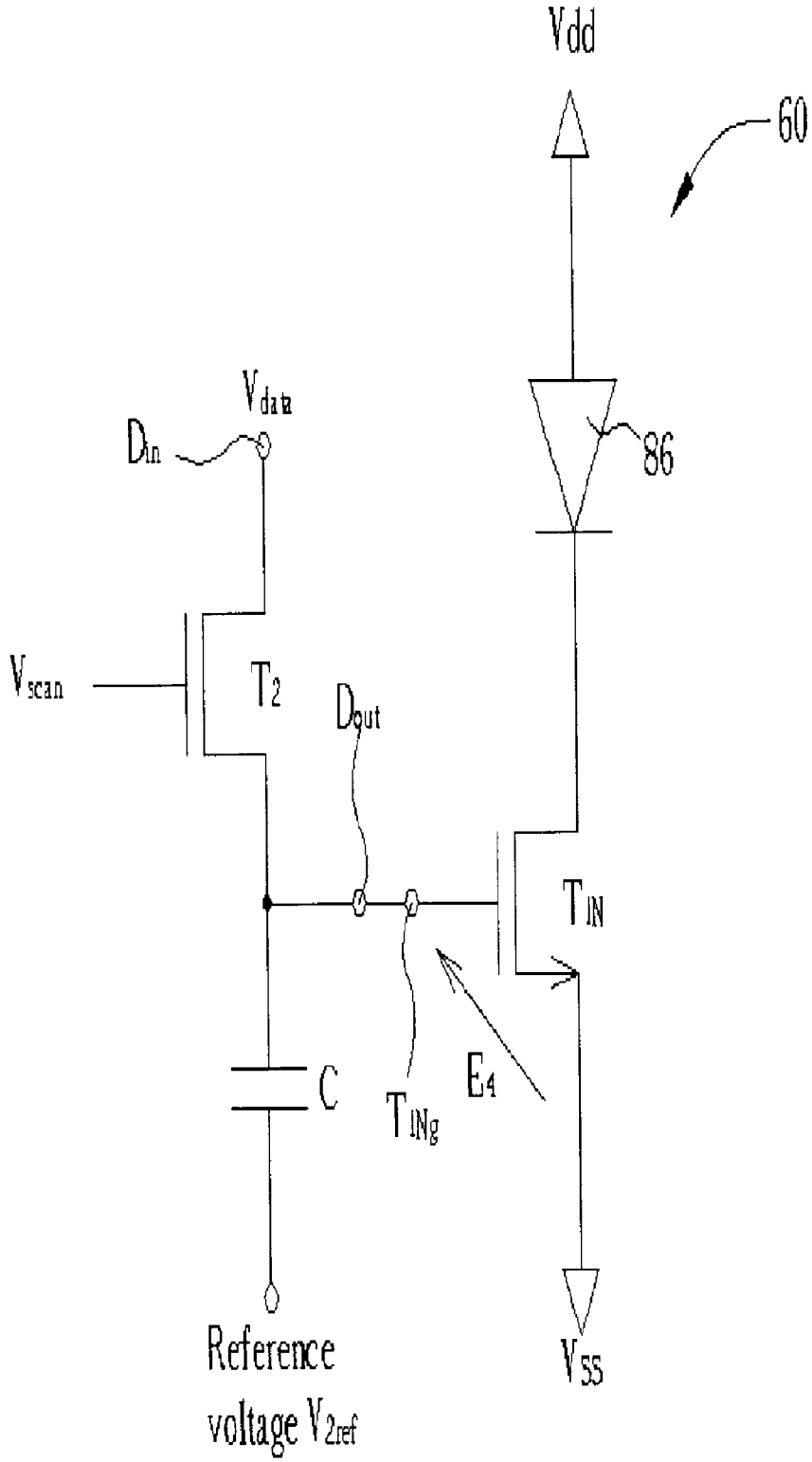
FIG. 7 is a circuit diagram of a second active display cell to drive an OLED according to the present invention.
Figure 8:
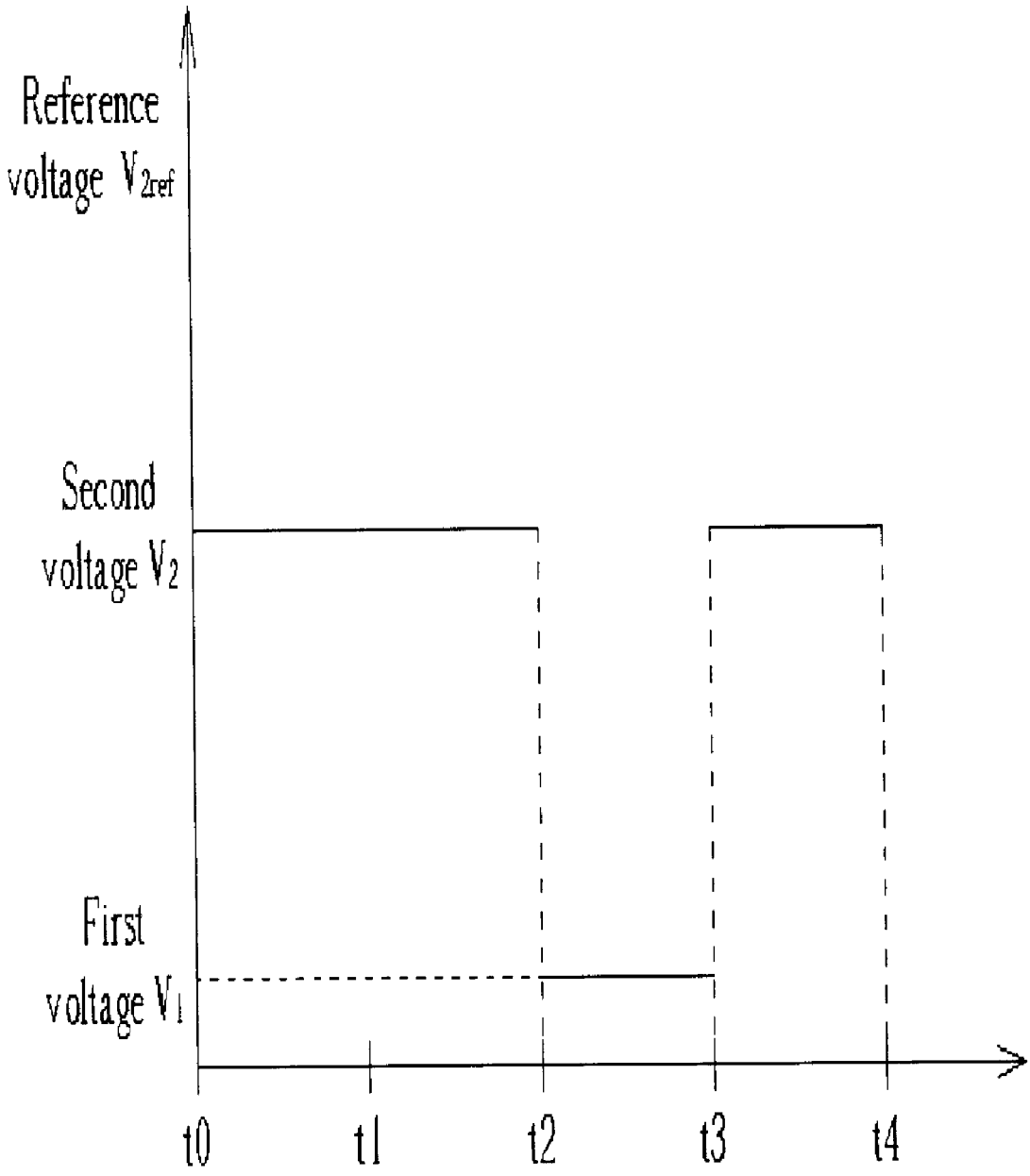
FIG. 8 is a first timing diagram of a first reference voltage source applied to the driving circuit shown in FIG. 7 according to the present invention.
Figure 9:
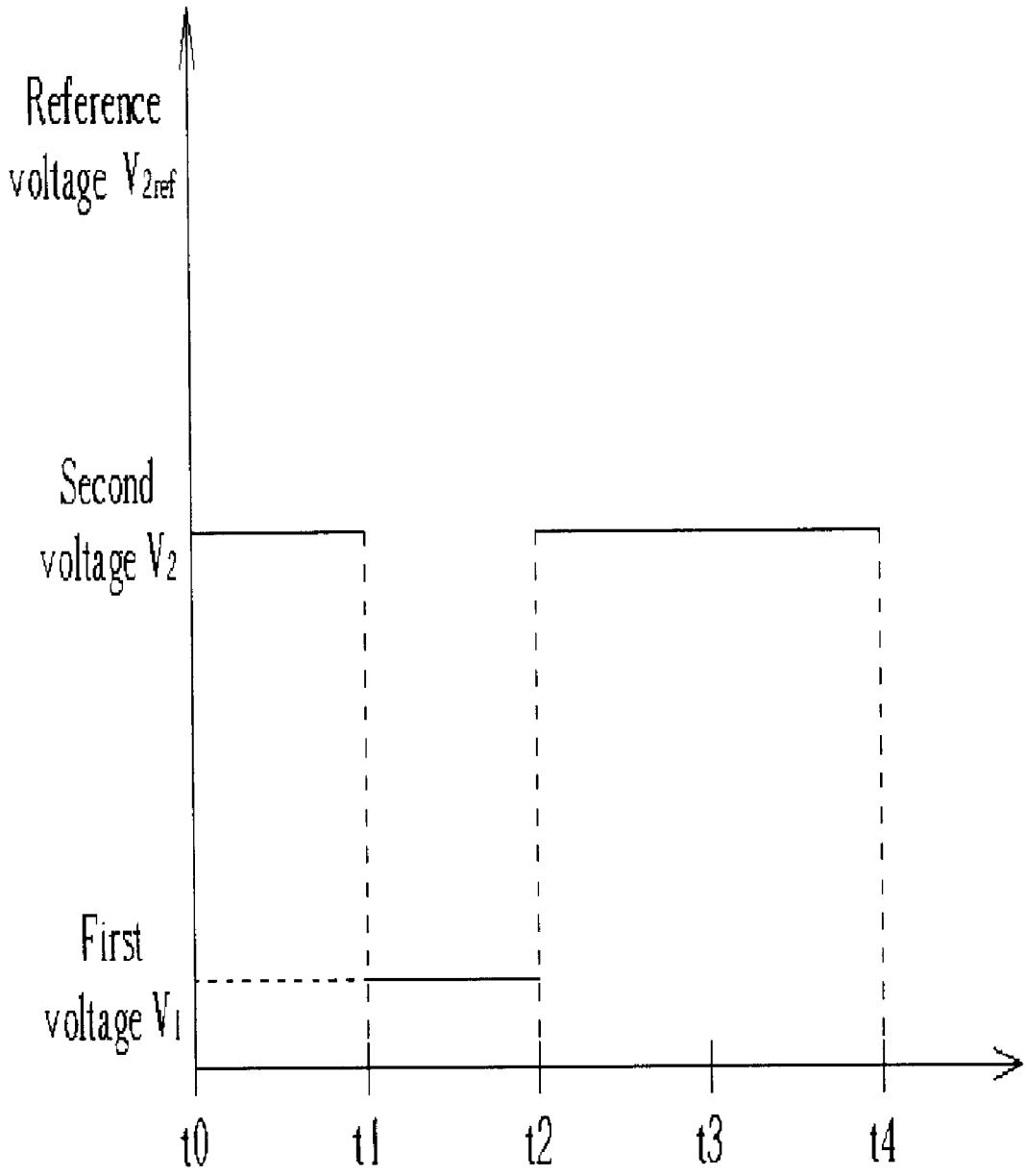
FIG. 9 is a second timing diagram of a first reference voltage source applied to the driving circuit shown in FIG. 7 according to the present invention.
Figure 10:
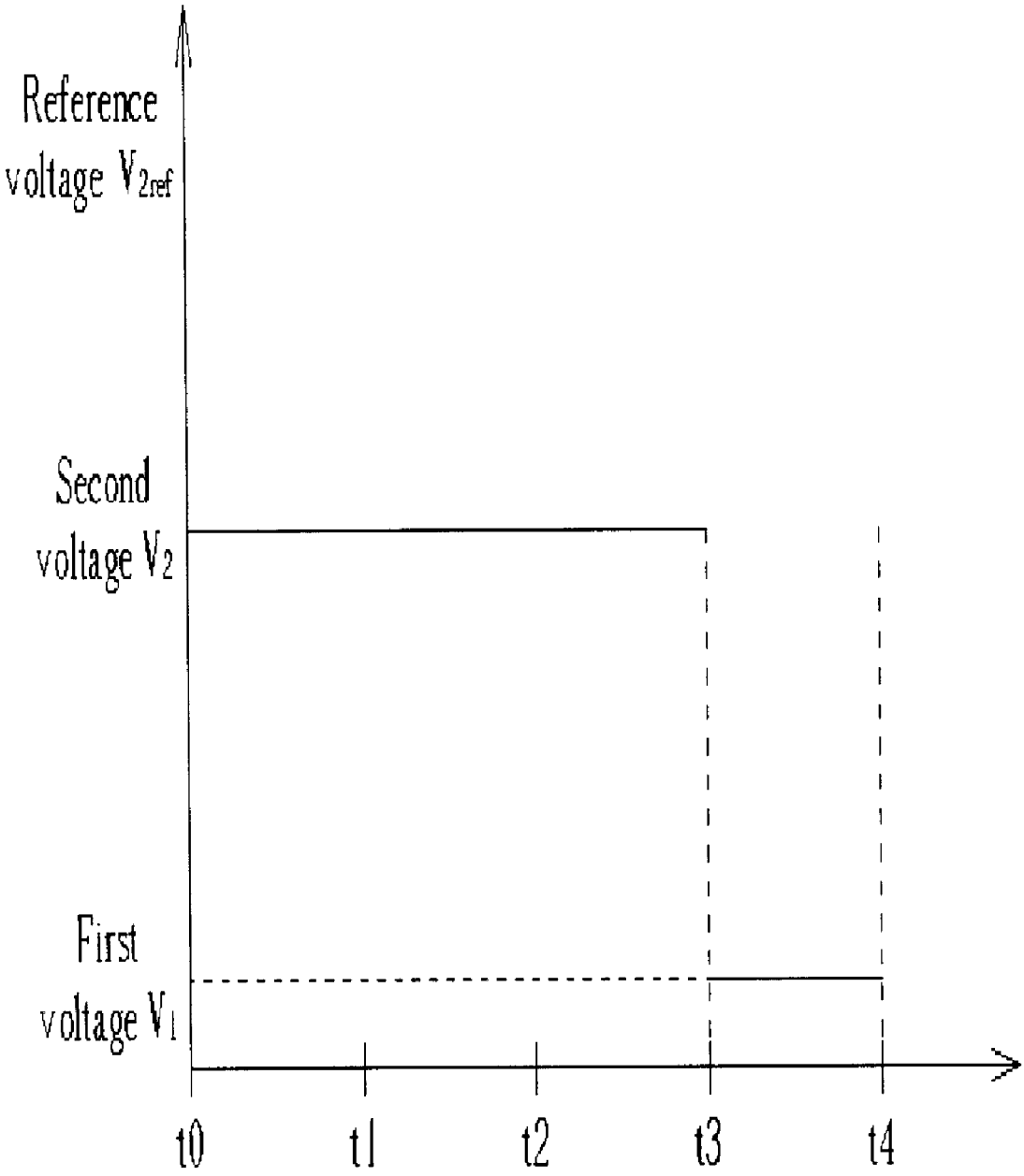
FIG. 10 is a third timing diagram of a first reference voltage source applied to the driving circuit shown in FIG. 7 according to the present invention.

Operations of the driving circuit 60 shown in FIG. 7 are similar to those of the driving circuit 40 shown in FIG. 3. An only difference is that the timing diagram of the second reference voltage source $V_{2ref}$ to vary a voltage at the first end of the capacitor C is different from that of the first reference voltage source $V_{1ref}$, in the second reference voltage source $V_{2ref}$ the first voltage $V_1$ being greater than the second voltage $V_2$. Please refer to FIG. 8 to FIG. 10, which are three distinct timing diagrams of the second reference voltage source $V_{2ref}$ of the driving circuit 60 according to the present invention. Operations of the driving circuit 60 are described as follows: the second reference voltage source $V_{2ref}$ is assumed here to generate the first voltage $V_1$ and the second voltage $V_2$ according to the timing diagram shown in FIG. 8. The scan voltage source $V_{scan}$ is controlled to start to output a voltage to turn on the second MOS transistor $T_2$ so that data at the input end $D_{in}$ of the second MOS transistor $T_2$ can be transmitted to the output end $D_{out}$ of the second MOS transistor $T_2$ (the first end of the capacitor C) until a voltage at the first end of the capacitor C (the gate $T_{1ng}$ of the first NMOS transistor $T_{1n}$) is equal a data voltage $V_{data}$ of the data. Currents flowing through the first NMOS transistor $T_{1n}$ for controlling the intensity of light emitted by the OLED 86 at this moment vary with the change of a voltage at the gate $T_{1ng}$ of the first NMOS transistor $T_{1n}$ (the voltage at the first end of the capacitor C, data voltage $V_{data}$). That is, the higher the data voltage $V_{data}$ of the data is, the greater voltages at the first end of the capacitor C and the gate $T_{1ng}$ of the first NMOS transistor $T_{1n}$ become. A voltage of a higher voltage level at the gate $T_{1ng}$ of the first NMOS transistor $T_{1n}$ enables the first NMOS transistor $T_{1n}$ itself to flow through currents of greater levels and drives the OLED 86 to emit light with greater intensity, accomplishing the function of the driving circuit 60 to adjust the intensity of light emitted by the OLED 86 by determining the data.

After the voltage at the first end of the capacitor C is charged to be equal to the data voltage $V_{data}$ of the data, the scan voltage source $V_{scan}$ is controlled to output a voltage at the time $t_1$ to turn off the second transistor $T_2$ and turn off the second transistor $T_2$, and a voltage of the second reference voltage source $V_{2ref}$ is adjusted sequentially. A voltage difference between the first and the second end of the capacitor C at the time $t_1$ is equal to a voltage subtracted by the first voltage $V_1$ from the data voltage $V_{data}$. Because the second transistor $T_1$ is kept turned off after the time $t_1$, charges stored in the capacitor C have no way to flow and the voltage difference between the first and the second end of the capacitor C does not change. As the second reference voltage source $V_{2ref}$, which is connected to the second end of the capacitor C, generates the first voltage $V_1$ during the intervals from times $t_1$ to $t_2$ and from times $t_3$ to $t_4$, a voltage at the first end of the capacitor C (the gate $T_{1ng}$ of the first NMOS transistor $T_{1n}$) is equal to the data voltage $V_{data}$. As the second reference voltage source $V_{2ref}$ generates the second voltage $V_2$ during the interval from times $t_2$ to $t_3$, the voltage at the first end of the capacitor C is equal to the data voltage $V_{data}$+the second voltage $V_2$ the first voltage $V_1$. A voltage decreased at the first end of the capacitor C (the first voltage $V_1$ the second voltage $V_2$) forms an electric field $E_4$, whose direction is opposed to the direction of the electric field $E_3$, on a region between the source and the gate $T_{1ng}$ of the first NMOS transistor $T_{1n}$ equivalently. The electric field $E_4$ is capable of decreasing a number of electrons accumulated in the region between the source and the gate $T_{1ng}$ of the first NMOS transistor $T_{1n}$, accomplishing the goal to stabilize the threshold voltage $V_{th}$ and to enable the OLED to emit stable light.

In contrast to the prior art, the present invention can provide a method to stabilize the threshold voltage $V_{th}$ of a transistor to drive a TFT. Additionally, the present invention has the capability to eliminate the charges accumulated in the FTF to stabilize the threshold voltage $V_{th}$ and to enable the OLED to emit stable light.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for driving an organic light emitting diode (OLED), the method comprising:

(a) providing a first metal oxide semiconductor (MOS) transistor, whose first and second ends are connected to the OLED and to a first voltage source respectively;

(b) providing a capacitor, whose first end is connected to a gate of the first MOS transistor;

(c) providing a second MOS transistor, whose first end is utilized for inputting data, a second end of the second MOS transistor being connected to the first end of the capacitor;

(d) turning on the second MOS transistor and inputting data from the first end of the second MOS transistor to the second end of the second MOS transistor; and (e) turning off the second MOS transistor after step (d), and adjusting a voltage at a second end of the capacitor from a first voltage level to a second voltage level different from the first voltage level sequentially.

2. The method of claim 1, wherein the first voltage level is lower than the second voltage level.

3. The method of claim 1, wherein the first voltage level is greater than the second voltage level.

4. The method of claim 1, wherein step (e) comprises: after the voltage at the second end of the capacitor has been adjusted to a voltage level equal to the second voltage level, adjusting the voltage at the second end of the capacitor to a voltage level equal to the first voltage level again.

5. The method of claim 1, wherein the first MOS transistor is a thin film transistor (TFT).

6. The method of claim 1, wherein the first MOS transistor is a PMOS transistor.

7. The method of claim 1, wherein the first MOS transistor is an NMOS transistor.

8. A method for driving an organic light emitting diode (OLED), the method comprising:

(a) providing a first metal oxide semiconductor (MOS) transistor, whose first and second ends are connected to the OLED and to a first voltage source respectively;

(b) providing a capacitor, whose first end is connected to a gate of the first MOS transistor;

(c) providing a second MOS transistor, whose first end is utilized for inputting data, a second end of the second MOS transistor being connected to the first end of the capacitor;

(d) turning on the second MOS transistor and inputting data from the first end of the second MOS transistor to the second end of the second MOS transistor (e) setting a voltage at a second end of the capacitor to a first voltage level;

(f) turning off the second MOS transistor after performing step (e);

(g) after step (f), adjusting the voltage at the second end of the capacitor from the first voltage level to a second voltage level for discharging the capacitor; and (h) after step (g), returning the voltage at the second end of the capacitor from the second voltage level to the first voltage level.

9. The method of claim 8, wherein the first voltage level is lower than the second voltage level.

10. The method of claim 8, wherein the first voltage level is greater than the second voltage level.

11. The method of claim 8, wherein the first MOS transistor is a thin film transistor (TFT).

12. The method of claim 8, wherein the first MOS transistor is a PMOS transistor.

13. The method of claim 8, wherein the first MOS transistor is an NMOS transistor.

* * * * *